United States Patent [19]

Winrow

[11] 4,243,978

[45] Jan. 6, 1981

[54] DISPLAY OR INDICATING DEVICE WITH MAGNETIC STOP

[75] Inventor: Donald Winrow, Weston, Canada

[73] Assignee: Ferranti-Packard Limited, Mississauga, Canada

[21] Appl. No.: 82,067

[22] Filed: Oct. 5, 1979

[51] Int. Cl.[3] ..... G08B 5/24

[52] U.S. Cl. ..... 340/373; 340/378.5

[58] Field of Search ..... 340/378.5, 373; 40/449

[56] References Cited

U.S. PATENT DOCUMENTS 3,518,664 6/1970 Taylor ..... 340/378.5 X

*Primary Examiner*—Harold I. Pitts

[57] ABSTRACT

A rotatable display or indicating element mounts a permanent magnet and is rotated greater than 90° and less than 180° between mechanical stops by an exterior pole piece of reversible polarity. A small permanent magnet adjacent the pole piece is designed with the locus of the rotatably mounted magnet to provide a stable position for the element just inward of the mechanical limiting position.

4 Claims, 8 Drawing Figures

DISPLAY OR INDICATING DEVICE WITH MAGNETIC STOP

BACKGROUND OF THE INVENTION

This invention relates to electromagnetically operated display or indicating elements wherein a rotatably mounted disc contrastingly coloured on opposite sides is controlled by a reversible, exterior magnetic field, created by one or two electromagnetically energized poles or "pole pieces" which controls a magnet mounted on and rotatable with the disc to cause the disc to display one or the other of its contrasting faces in a viewing direction. Such discs may be used singly as indicators or may be used in multiple arrays to collectively convey information to a viewer.

Examples of such arrangements are shown in U.S. Pat. Nos.

3,295,238; Jan. 3, 1967; D. Winrow
3,303,494; Feb. 7, 1967; M. K. Taylor et al
3,385,824; Jan. 30, 1968; D. Winrow
3,871,945; Mar. 18, 1975; D. Winrow et al
3,996,680; Dec. 14, 1967; C. N. Smith
3,156,872; May 29, 1979; G. Helwig and all assigned to the applicant herein.

In some variations of such arrangements, the rotation of the disc, on reversal of the exterior field has been limited to a small amount less than 180° by a mechanical stop or stops, which are arranged relative to the exterior field so that on each rotation of the disc it is mechanically stopped short, by a small angle, of the position where the permanent magnet aligns with the exterior field. As a result, when the exterior field is reversed, the rotary disc and magnet are impelled in only one direction by the exterior field and one major cause of maloperation or "hang ups" was avoided. Such an arrangement is exemplified by U.S. Pat. No. 3,295,238 referred to above. The use of such mechanical stopping although it has removed a cause of operating failure, has introduced a further cause of such failure. In some cases, particularly under conditions of high humidity, there has been a tendency of the rotating disc to adhere, after a period of rest to the mechanical stop, causing it, where such adherence occurs, to refuse to move when the exterior field is reversed to cause such movement. Reduction of the occurrence of this adherence has hitherto been achieved only by expensive cleaning and neutralizing operations to remove foreign films acquired during normal manufacturing processes.

SUMMARY OF THE INVENTION

This invention provides means for avoiding the adherence between the disc and the stop, in a disc limited by mechanical stops to less than 180° rotation. Such means comprises at least one second permanent magnet mounted exterior to the disc and near, or on, one of the pole pieces. The strength and location of the second permanent magnet is selected to produce a smaller field than that provided by the pole pieces in either polarity and is so located and selected relative to the pole piece and the locus of the rotating (or 'first') permanent magnet, that (1) it tends to repel the approaching magnet of the rotating element moving under the effect of (and in either sense of) the reversible magnetic field, and (2) the repulsion by the second permanent magnet has a lesser effect than the pole piece over the major portion of the arc of movement of the disc between mechanical limiting positions. However, as the disc nears whichever limiting position it is then approaching, the second permanent magnet is so located that an angular position is reached where the repulsion due to the second permanent magnet equals then exceeds the magnetic effect on the disc by the pole piece. The disc will therefore come to rest, on travel in either direction, at the position where the forces exerted by the pole pieces which form the exterior field and these exerted by the second permanent magnet are equal and opposite (the 'stable position' herein). When the magnetization sense of the pole piece is then reversed, the disc moves in the opposite direction, coming to rest angularly adjacent but short of the opposite mechanical limiting position, where, again the effects of the pole pieces and of the second permanent magnet are equal. It will be noted that it is possible with such a device that the rotating disc will stop as its stable position without striking the mechanical stop. However, it is found that, more often, the momentum of the disc, will cause it to rotate past the stable position, to strike the mechanical stop, and then rebound to the stable position. It is found that the "bounce" of the rotating element off the mechanical stop does not cause adherence thereto and that faulty operation by such adherence is substantially eliminated by this development.

BRIEF DESCRIPTION OF THE DRAWINGS

In drawings which illustrate a preferred embodiment of the invention.

DESCRIPTION OF THE PREFERRED EMBODIMENT

Figure 1:
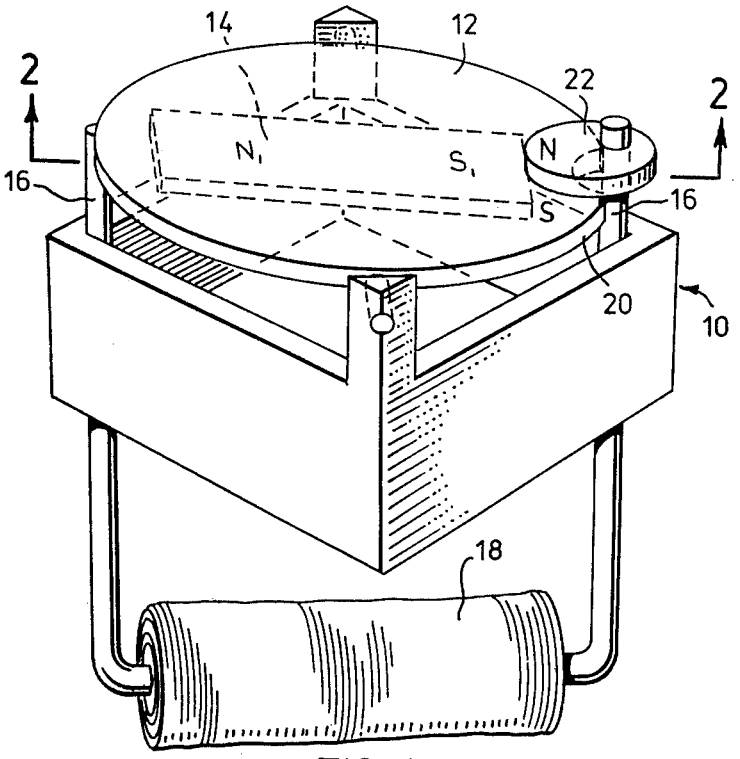
FIG. 1 shows a display or indicating device in accord with the invention.
Figure 2:
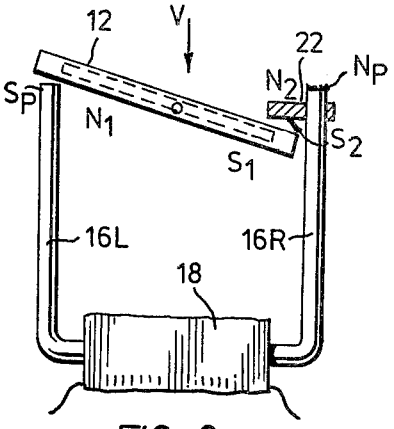
FIGS. 2 and 3 schematically indicate the operation of the device of FIG. 1.
Figure 3:
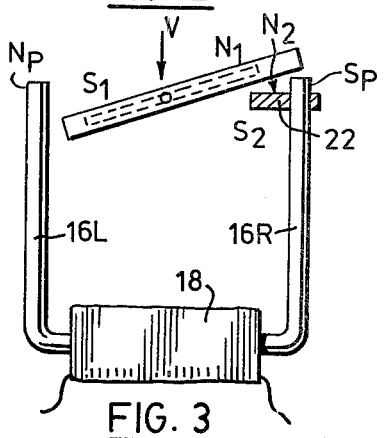
Figure 4:
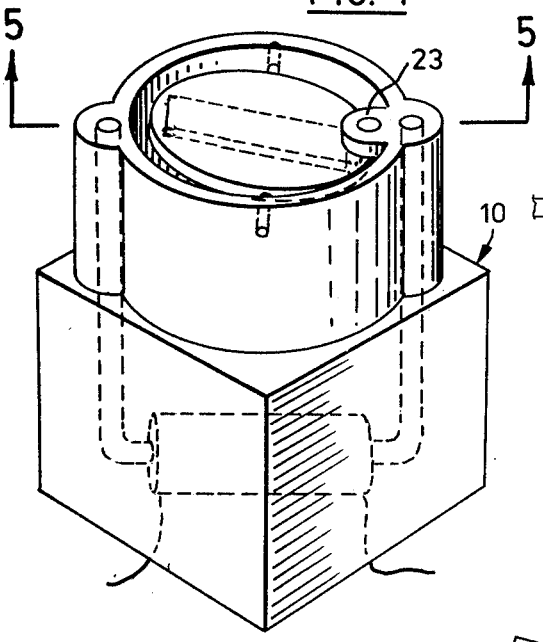
FIG. 4 shows a an alternative form of display or indicating device to that shown in FIG. 1, FIGS. 5 and 6 schematically illustrate the operation of the device of FIG. 4, FIGS. 7 and 8 show a further alternative embodiment.
Figure 5:
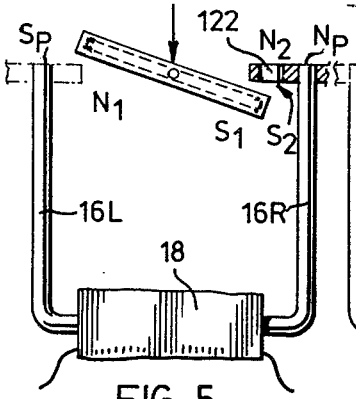
Figure 6:
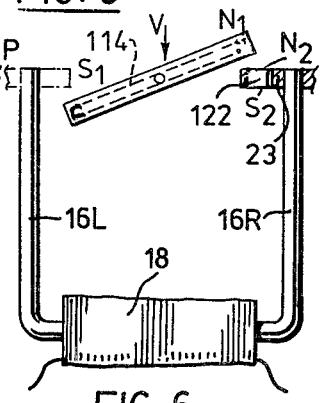

In the drawings: FIG. 1 shows a housing 10 which pivotally mounts a rotatable disc 12. A permanent magnet 14 (the 'first permanent magnet' in the claims) mounted for rotation with the disc defines a magnetic axis having a component transverse to the pivotal axis. The housing also mounts a pair of reversibly permanently magnetizable pole pieces 16 connected in a rectangular U-shaped arrangement, energized by a winding 18. The U-shaped pole piece forming member is made of reversible permanently magnetizable material which may be pulsed by short-duration current in the winding 18 to cause the pole pieces 16 to assume one sense of magnetization. Due to the magnetic qualities of the pole pieces 18, they will then retain such magnetization without sustaining current in winding 18 until the winding is pulsed in the reverse sense. The winding is thus pulsed each time it is desired to alter the side of the disc face displayed in the viewing direction V. The disc is contrastingly coloured on opposite sides and the appearance is contrastingly altered to the viewer in the viewing direction. The two limiting positions of the disc are those which it would assume if resting against the end of pole piece 16 L in FIG. 2 and the end of pole piece 16 R in FIG. 3. The mechanical stops provided by the ends of pole pieces 16 L and 16 R prevent alignment of disc 12 with the pole piece field so that the disc will only attempt to rotate in one direction when the pole piece magnetization is reversed. The mechanical stops thus limit rotation of the disc between limiting position to a little less than 180° between two mechanically defined limiting positions. (The disc rotation will always be greater than 90° and less than 180°). In the preferred embodiment the mechanical stop is provided by constructing the disc 12 of sufficient diameter to contact the pole piece. One side of the disc is then cut out at 20 so that only one side can contact the pole pieces. The opposite side of the disc rests on a pole piece end in either orientation, as the schematic view of FIGS. 2 and 3 show, to limit the rotation as discussed. The mechanical stop may of course be separate from pole piece as the embodiment of FIGS. 4–6 illustrates.

The components and operation of the device of FIG. 1–3 thus far described are in accord with the prior art. To this construction there is added a magnet 22 of less field strength than the field produced by the pole pieces, and mounted adjacent one of such pole pieces (here 16 R) and located and oriented to have a greater and opposite magnetic effect to the pole piece 16R, on the rotating magnet 14, when the disc is at its mechanical limiting position.

(For ease in understanding the magnetic effects the following convention is used: permanent magnet 14 on the disc has north and south poles $N_1$ and $S_1$; permanent magnet 22 on pole piece 16R has north and south poles $N_2$ and $S_2$; pole pieces 16L and 16R have reversible magnetization. Thus in FIG. 2 pole piece 16R is a north pole $N_p$ and in FIG. 3 pole piece 16R is a south pole $S_p$. In each case pole piece 16L will form the opposite pole). There is thus defined, for each polarization of the pole pieces 16, a stable position for the disc 12 angularly adjacent the mechanical limiting position, where the repulsion due to the added magnet 22 and the attraction due to the adjacent pole pieces 16 are equal. These positions are illustrated by the attitude of the disc 12 in FIGS. 2 and 3. In the preferred embodiment of FIG. 1, the added magnet 22 takes the form of a disc magnetized perpendicular to its thickness, as illustrated. The magnet 22 is provided with an aperture and mounted on the pole piece 16R. In the preferred embodiment the aperture is located and the magnet mounted to be eccentric. This is done so that all of the magnet 22 may be located inward of the lateral bounds of housing 10. Since the disc 12 is attracted by the north pole $N_1$ of its magnet 14 toward pole pieces 16R in the position of FIG. 3 and by the south pole piece $S_1$ of its magnet in the position of FIG. 2, the added magnet 22 is oriented so that its poles $N_2$-$S_2$ oppose the polarity of the pole piece 16R for each of the directions of attraction, so that $N_2$ is directed up and $S_2$ down. Since a part of magnet 22 is located closer to the arc of poles $N_1$-$S_1$ of the rotating magnet 14 than pole piece 16R, and magnet 22 is of weaker field strength, then for either stable position of FIG. 2 or FIG. 3, the field of pole pieces 16 and the field of magnet 14 are equal and opposite. Between these respective stable positions and the mechanical limiting positions the repulsion of magnet 22 is greater than the attraction by pole pieces 16; while over the arc between one stable position and the other, the attraction by the pole pieces is stronger than the repulsion of magnet 22.

Thus, in operation, when the disc is stationary, the winding 16 is deenergized, the pole pieces 16 will be magnetized in one direction and the disc 12 will be in one stable attitude, say, that of FIG. 2. When the disc 12 is to be rotated, the winding 18 is pulsed to reverse the magnetization of the pole pieces 16. The magnet 14 with disc 12 is thus rotated toward the position of FIG. 3. Such rotation continues past the stable position of FIG. 3 after which the repulsion of magnet 22 drives the disc 12 back toward the stable position (of FIG. 3). As previously noted, such 'overshoot' of the stable position, during rotation of the disc may or may not, but usually will, strike the pole piece 16R before rebounding to the stable position. Similarly, in the attitude of FIG. 3, on reversal of the polarity of the pole pieces, the disc 12 moves toward the orientation of FIG. 2 until the repulsion by magnet 22 on magnet 14 is greater than the attraction of the pole piece field on the rotary magnet. Then with or without the disc striking the top of pole piece 16L, the disc assumes the stable position of FIG. 2. In both attitudes, the stable position is slightly spaced angularly inwardly from the mechanical stop. In this manner the tendency for adherence of the disc to the stop is substantially eliminated.

If desired, and if the magnet 22 is too weak to have the desired effect, a magnet 22 may be similarly located on the left-hand pole piece 16L. The operation will be as above described the two magnets 22 exerting a combined effect upon the disc magnet.

FIG. 4 shows an alternative embodiment of the invention having similar components and mode of operation except that a separate mechanical stop 23 is provided, moulded as part of the housing 10. It will be noted that stop 23 limits rotation of the disc at both ends of the arc of movement. The disc 114 is made smaller in diameter than the spacing of pole pieces 16. The auxiliary or second permanent magnet 122 is separate from the adjacent pole piece 16R and mounted in the stop 23. As demonstrated by FIGS. 5 and 6 each stable position of the disc, defined by repulsion by a pole of magnet 122 equal to the attraction of the pole pieces 16, is spaced from the mechanical stop position and adherence of the disc to the stop is substantially eliminated.

As explained, in connection with the embodiment of FIGS. 1–3, the operation of the device of FIGS. 4–6 may require an exterior permanent magnet 122 on each pole piece. Such use of two exterior magnets is indicated in FIGS. 5 and 6 by the dotted outline of one of such magnets on the left hand pole piece 16L.

Figure 7:
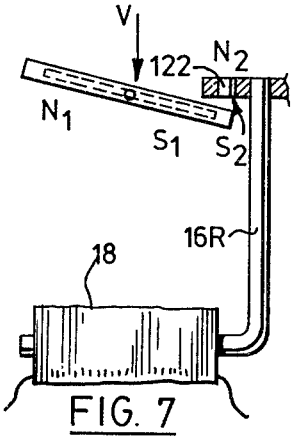
Figure 8:
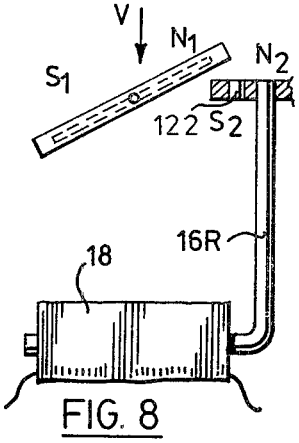

The invention is applicable to the alternative where only one pole piece is used as schematically illustrated in FIGS. 7 and 8. This would appear as the embodiment of FIG. 4 with the left hand pole piece 16L removed. The use of only one pole piece to produce the entire pole piece field can be successful, since the strengths of the pole piece 16 and magnet 22 and magnet 14 may be adjusted for this alternative.

In each of the embodiments the length of the rotor magnet 14 or 114 is such that an extension of its rotational arc would cut the exterior permanent magnet 22 or 122. This is to avoid any undue lessening of the repulsive effect of the exterior magnets 22 or 122 near the respective limiting position. It is within the scope of the invention to shorten the length of the rotor magnet so that its arc (extended) is inward of the location of the exterior permanent magnet 22 or 122. However the extent to which the extended arc may be inward of the magnets 22 or 122 without prevention operation of the device as described will depend on a number of factors in each case, including the strength and configuration of the magnets 22 or 122, the magnets 14 or 114 and of the pole pieces 16L and 16R. Thus the inward limits must be determined empirically on each case unless the arc (extended) of the magnets 14 or 114 cuts the magnets 22 or 122.

I claim:

1. In an electronic display or indicating element, wherein a rotatably mounted disc is designed to provide visually contrasting surfaces on opposite sides, means mechanically limiting the rotation of the disc between two limiting positions >90° and <180° apart, in which limiting positions, the respective contrasting surfaces are displayed in a viewing direction, a first permanent magnet mounted for rotation with said element, arranged to produce a field having a component transverse to the rotational axis of said disc, at least one reversibly magnetizable pole piece and energizing means therefor, exterior to said disc, designed and connected to provide a first exterior magnetic field that in the absence of a second exterior magnetic field, each reversal of energization of said pole piece would rotate said permanent magnet and said disc from one limiting position to the other, a second permanent magnet, of less magnetic field strength than that associated with said at least one pole piece, and mounted adjacent thereto, said second permanent magnet being designed and located relative to the locus of said first magnet during rotation of said disc to produce with said pole piece, in either magnetization, a magnetically stable position for said rotatable disc spaced by a small angle from the mechanical limiting position toward the other limiting position, whereby upon reversal of said pole piece magnetization, said disc is attracted from its former magnetically stable position toward the other magnetically stable position.

2. An electronic display or indicating device wherein a rotatably mounted disc is designed to provide visually contrasting surfaces on opposite sides, means mechanically limiting the rotation of the disc between two limiting position >90° and <180° apart, in which respective limiting positions the contrasting surfaces are displayed in a viewing direction, a first permanent magnet mounted for rotation with said element, arranged to produce a field having a component transverse to the rotational axis of said disc, at least one reversibly magnetizable pole piece and energizing means therefor, exterior to said disc, designed and connected to produce a first exterior magnetic field such that, in the absence of a second exterior magnetic field, each reversal of said pole piece would rotate said disc from one limiting position to the other, a second permanent magnet exterior to said disc located adjacent to said at least one pole piece and oriented to repel the then closer pole of the first permanent magnet on approach to each limiting position, the strength and location of said second permanent magnet being selected, so that, the composite field of said at least one pole piece and said second permanent magnet for either magnetization of said pole piece creates a stable position, a short distance angularly displaced from the corresponding mechanical limiting position, and, so that, on reversal of said pole piece magnetization, between the stable positions, the effect of said at least one pole piece on said first permanent magnet is greater than that of said second permanent magnet, and between said stable position and the mechanical limiting position the repulsion of said second permanent magnet is greater than the attractive force on said first permanent magnet of said at least one pole piece.

3. In a device as claimed in claim 1 where two said pole pieces are provided.

4. In a device as claimed in claim 2 where two said pole pieces are provided.

* * * * *

UNITED STATES PATENT AND TRADEMARK OFFICE

CERTIFICATE OF CORRECTION

PATENT NO. : 4,243,978

DATED : January 6, 1981

INVENTOR(S) : Donald Winrow

It is certified that error appears in the above—identified patent and that said Letters Patent is hereby corrected as shown below:

Claims 1 and 2, line 1, the word "electronic" should read -- electromagnetic --.

On the title page, the descriptive figure and figure 1 should appear as shown on the attached sheet.

Signed and Sealed this

*Twelfth* Day of *May 1981*

[SEAL]

*Attest:*

RENE D. TEGTMEYER

*Attesting Officer* *Acting Commissioner of Patents and Trademarks*

UNITED STATES PATENT AND TRADEMARK OFFICE

CERTIFICATE OF CORRECTION

PATENT NO. :4,243,978

DATED :January 6, 1981

INVENTOR(S) :Donald Winrow

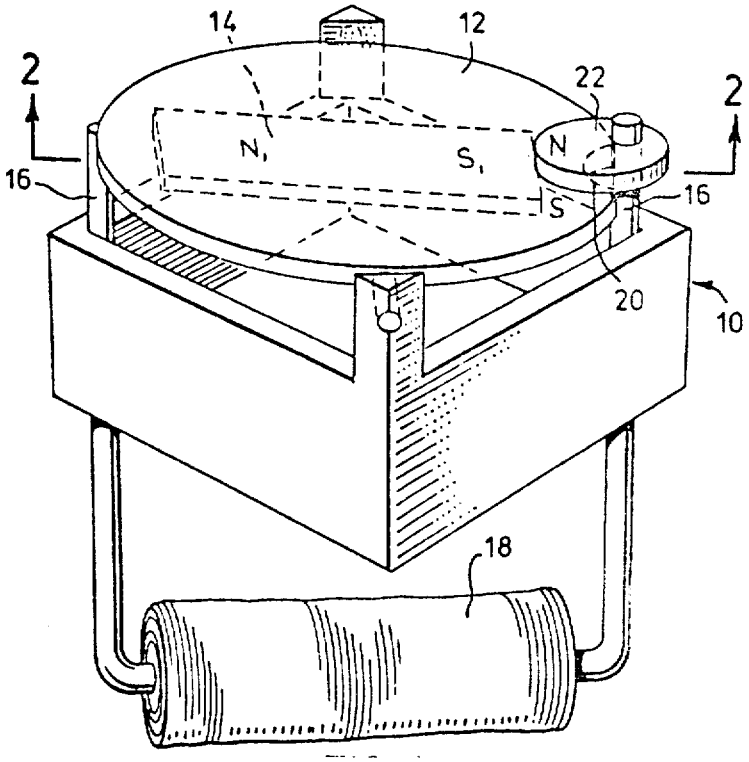

It is certified that error appears in the above—identified patent and that said Letters Patent is hereby corrected as shown below: